US005534747A

United States Patent [19]

Carruthers

[11] Patent Number: 5,534,747

[45] Date of Patent: Jul. 9, 1996

[54] VARIABLE FOCUS ELECTRON GUN ASSEMBLY WITH CERAMIC SPACERS

[75] Inventor: Malcolm J. Carruthers, San Jose, Calif.

[73] Assignee: Litton Systems, Inc., Woodland Hills, Calif.

[21] Appl. No.: 242,265

[22] Filed: May 13, 1994

[51] Int. Cl.[6] ..... H01J 29/46

[52] U.S. Cl. ..... 313/456; 313/417; 313/270

[58] Field of Search ..... 313/441, 456, 313/417, 270, 237

[56] References Cited

U.S. PATENT DOCUMENTS

| | | | |
|---|---|---|---|
| 3,046,442 | 7/1962 | Cook | 313/456 |
| 3,588,574 | 6/1971 | Hogg | 313/237 |
| 3,601,649 | 8/1971 | Steigerwald | 313/237 |
| 3,706,002 | 12/1972 | Miram et al. | 313/456 |
| 3,903,450 | 9/1975 | Forbess et al. | 313/452 |
| 3,979,634 | 9/1976 | Jaillet et al. | 313/441 |
| 4,023,061 | 5/1977 | Berwick et al. | 313/349 |
| 4,145,635 | 3/1979 | Tuck | 313/299 |
| 4,500,809 | 2/1985 | Odenthal et al. | 313/456 |
| 4,545,064 | 10/1985 | Klosterman | 313/237 |
| 4,593,230 | 6/1986 | True | 313/349 |
| 4,644,219 | 2/1987 | Huebner | 313/441 |
| 4,748,369 | 5/1988 | Phillips et al. | 313/237 |
| 4,803,398 | 2/1989 | Kraft et al. | 313/237 |
| 4,900,982 | 2/1990 | Kolpin | 313/237 |

*Primary Examiner*—Brian Zimmerman
*Assistant Examiner*—Michael Day
*Attorney, Agent, or Firm*—Graham & James

[57] ABSTRACT

An electron gun having a stacked construction is provided, comprising a cylindrical shell, a cathode concentrically disposed within the shell, and at least one spacing ring disposed within the shell in abutting engagement with the cathode. The cathode is electrically insulated from the shell by the spacing ring, which is comprised of an electrically insulative material. The cathode and spacing ring are held together within the shell by simple mechanical force, such that the cathode and spacing ring can be readily detached from the shell as desired. An additional electrode, such as an anode or grid, may also be concentrically disposed within the shell, with a second spacing ring disposed in abutting engagement with the cathode and the electrode. A third spacing ring may also be disposed between the electrode and a shoulder portion of the shell disposed at an end thereof. Relative position of the cathode with respect to the electrode is determined by selection of the width of the spacing rings, enabling a variety of focusing characteristics for the electron gun.

16 Claims, 2 Drawing Sheets

VARIABLE FOCUS ELECTRON GUN ASSEMBLY WITH CERAMIC SPACERS

BACKGROUND OF THE INVENTION

1. Field of the Invention

The present invention relates to an improved electron gun, and more particularly, to an electron gun assembly utilizing precision ground ceramic cylinders for precise alignment of the electron gun elements in order to simplify assembly and improve reliability.

2. Description of Related Art

It is well-known in the art to utilize a linear beam device within a traveling wave tube (TWT), klystron, or other microwave device. In such a linear beam device, an electron beam originating from an electron gun is caused to propagate through a tunnel or a drift tube generally containing an RF interaction structure. An RF wave can be made to propagate through the interaction structure so that it can interact with the electron beam which gives up energy to the propagating RF wave. Thus, the device may be used as an amplifier for increasing the power of a microwave signal. At the end of its travel, the electron beam is deposited within a collector or beam dump which effectively captures the remaining energy of the spent electron beam. The beam may be focused by magnetic or electrostatic fields in the interaction structure of the device to prevent its expansion due to space-charge forces and permit it to effectively travel from the electron gun to the collector without undesired energy loss to the interaction structure.

The electron gun which forms the electron beam typically comprises a cathode and an anode. The cathode includes an internal heater disposed below the cathode surface that raises the temperature of the cathode surface to a level sufficient for thermionic electron emission to occur. When the potential of the anode is made positive with respect to the cathode, electrons are drawn from the cathode surface and caused to move toward the anode. The geometry and placement of the cathode and the anode define the shape and position of equipotential contour lines of an electric field within the inter-electrode region between the cathode and anode. The equipotential contour lines define the electron flow pattern, since electrons tend to follow a path generally perpendicular to the equipotential contour lines. The flow of electrons then passes from the electron gun to the interaction region of the device. An electron gun of this type is known as a Pierce gun.

In a Pierce gun, the cathode and another electrode, such as the anode or a grid, are often disposed within a single assembly, though the anode may be disposed external to the electron gun. Electrically insulating materials are utilized within the electron gun assembly to maintain the electric field potential between the anode and the cathode, and to prevent electrical breakdown or arcing within the assembly. Since the positioning of the anode with respect to the cathode is critical to the determination of the electric field shape and position of the equipotential contour lines, the cathode and anode elements are generally fixed in position within the electron gun, such as by brazing. This way, the electron beam focusing characteristics will remain substantially unchanged during operation of the electron gun within a microwave device.

A significant drawback of this type of electron gun assembly is in the difficulty of its manufacture. Once the electron gun is assembled together, its focusing characteristics cannot be varied without disassembling the electron gun components, often requiring the breaking of permanent braze joints. The brazed construction does not allow for variation of the component spacing after assembly. As a result, it is difficult to customize electron guns for unique focusing characteristics.

Accordingly, an electron gun having improved assembly characteristics and which avoids the alignment problems of the prior art would be very desirable.

SUMMARY OF THE INVENTION

In accordance with the teachings of this invention, an electron gun having a novel stacked construction is provided. The electron gun comprises a cylindrical shell, a cathode concentrically disposed within the shell, and at least one spacing ring disposed within the shell in abutting engagement with the cathode. The cathode is electrically insulated from the shell by the spacing ring, which is comprised of an electrically insulative material. The cathode and spacing ring are held together within the shell by simple mechanical force, such that the cathode and spacing ring can be readily detached from the shell as desired.

In a first embodiment of the invention, a first spacing ring is concentrically disposed within the shell abutting a shoulder provided at a rim of the shell. An anode is concentrically disposed within the shell in abutting engagement with the first spacing ring, and a second spacing ring is disposed in abutting engagement between the anode and the cathode. A third spacing ring is disposed between the cathode and a locking ring disposed at an end of the cylindrical shell opposite from the rim. The locking ring maintains mechanical force on the spacing rings, the cathode and the anode, in the direction of the rim to rigidly hold the electron gun elements within the shell. Relative position of the anode and cathode is determined by selection of the width of the spacing rings, enabling a variety of focusing characteristics of the electron gun. Shims disposed between the anode, cathode, and spacing rings further permit precise alignment of the electron gun components.

In a second embodiment of the invention, an anode is disposed externally of the electron gun and comprises an end portion of a microwave amplifying device connected to the electron gun. A first spacing ring is concentrically disposed within the shell abutting a shoulder provided at a rim of the shell. A grid is concentrically disposed within the shell in abutting engagement with the first spacing ring, and a second spacing ring is disposed in abutting engagement between the grid and the cathode. A third spacing ring is disposed between the cathode and a locking ring disposed at an end of the cylindrical shell opposite from the rim. The locking ring maintains a mechanical force on the spacing rings, the cathode and the grid, in the direction of the rim to rigidly hold the electron gun elements within the shell. Relative position of the grid and cathode with respect to the anode is determined by selection of the width of the spacing rings, enabling a variety of focusing characteristics of the electron gun.

A more complete understanding of the electron gun will be afforded to those skilled in the art, as well as a realization of additional advantages and objects thereof, by consideration of the following detailed description of the preferred embodiment. Reference will be made to the appended sheets of drawings which will be first described briefly.

DETAILED DESCRIPTION OF THE PREFERRED EMBODIMENT

This invention provides an electron gun having improved assembly characteristics and which avoids the alignment problems of the prior art. The electron gun can be configured with the anode as an integral part of the gun, or the anode could comprise an element of a microwave device connected to the gun. The electron gun could further include a grid for controlling electron beam current.

Figure 1:
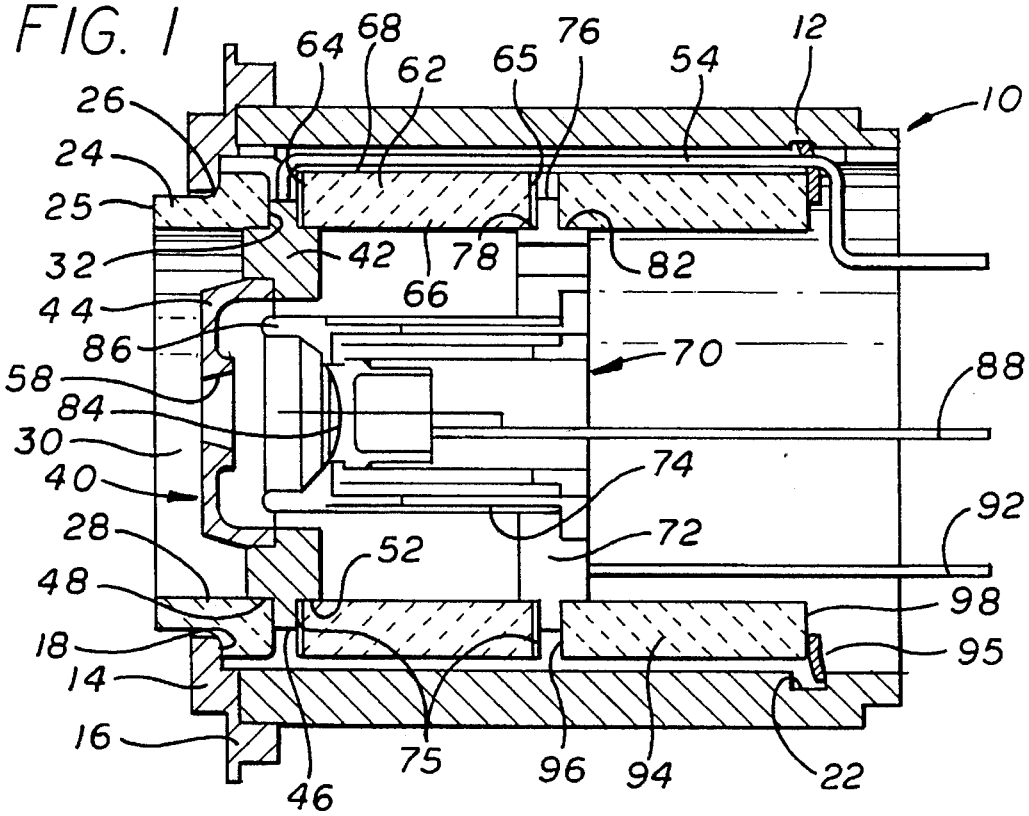
FIG. 1 is a sectional side view of an electron gun of the present invention.
Figures 3, 4:
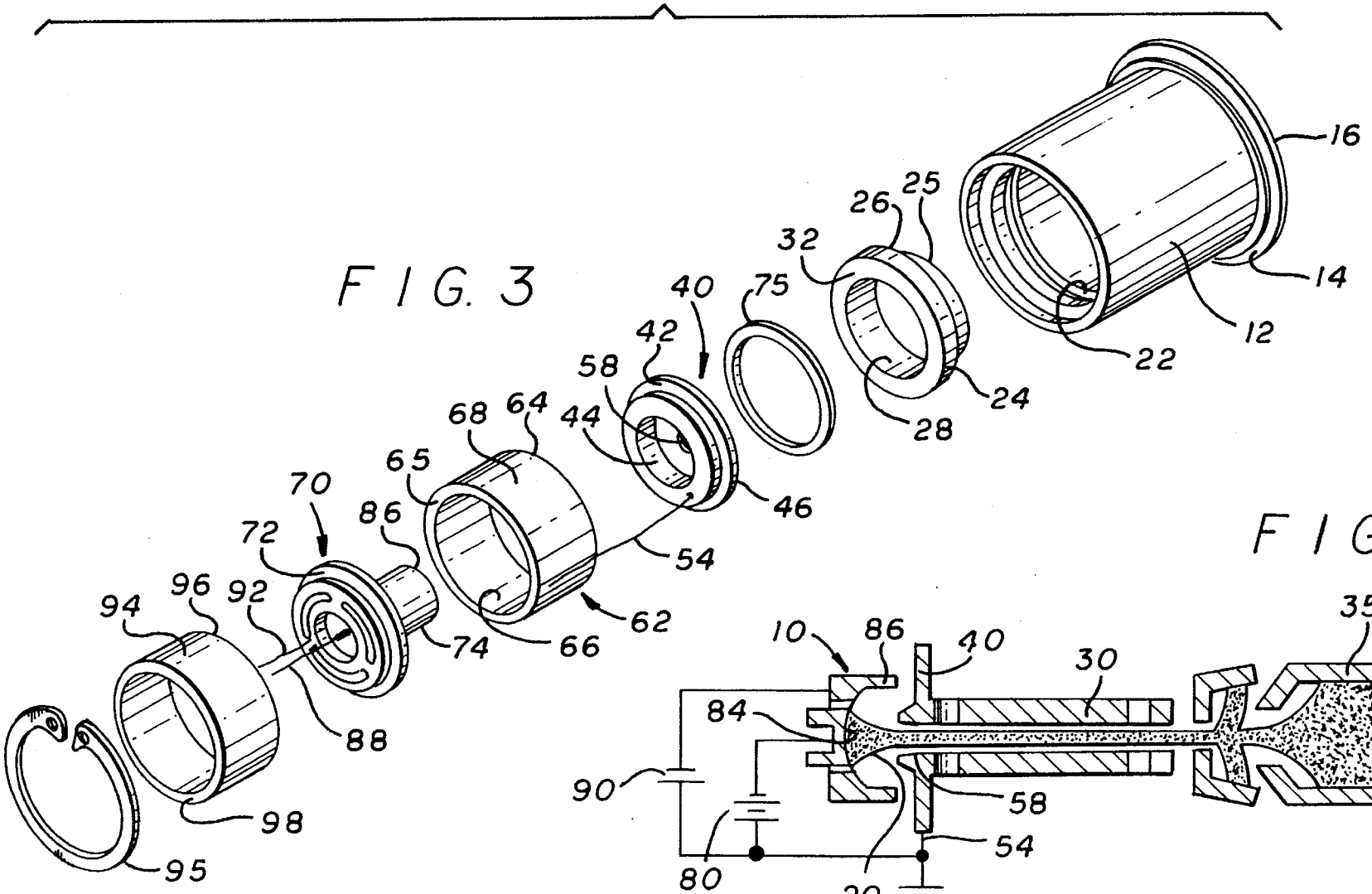
FIG. 3 is an exploded perspective view of the electron gun of FIG. 1.
FIG. 4 is a sectional side view of an electron gun in conjunction with a microwave device.

Referring first to FIGS. 1 and 3, a first embodiment of an electron gun assembly 10 is illustrated. The electron gun 10 comprises an outer shell 12 having a generally cylindrical shape. The shell 12 has a circular opening at either end thereof. A rim 14 is secured to a first end of the shell 12. The rim 14 has an end mounting face 16 for attachment of the electron gun 10 to a device capable of receiving an electron beam generated by the electron gun, such as a traveling wave tube or klystron, referred to herein as a microwave amplification device. The rim 14 further provides a shoulder 18 at an inward facing portion of the rim. At a second end of the shell 12, a groove 22 is provided at an inner surface of the shell. As will be clear from the following description, the precise dimensions of the shell are not critical to the focusing of the electron gun.

A first spacing ring 24 is disposed concentrically within the shell 12 in abutting engagement with the shoulder 18. The first spacing ring has a cylindrical inner surface 28. The thickness of the first spacing ring 24 tapers at an outer surface thereof from a narrow portion at a forward end 25 of the spacing ring to a wide portion at a rearward end 32 of the spacing ring. A transition region 26 disposed between the narrow portion and wide portion provides a stop for engagement with the shoulder 18 of the rim 14. Mechanical force applied to the first spacing ring 24 in the direction of the shoulder 18 holds the spacing ring firmly in place against the shoulder. It is anticipated that the first spacing ring 24 be comprised of an electrically insulative material, such as ceramic.

An anode 40 is disposed concentrically within the shell 12 in abutting engagement with the rearward end 32 of the first spacing ring 24. The anode 40 has a ring portion 42 and an aperture portion 44. The ring portion 42 has an outer edge 46 extending outwardly between steps 48 and 52. Step 48 engages rearward end 32 of the first spacing ring 24. An electrical conductor 54 extends from a portion of the outer edge 46 of the anode 40, and permits electrical connection of the anode to an external voltage source. The aperture portion 44 of the anode 40 has a central beam hole 58 having a funnel-shaped surface through which an electron beam of the electron gun is projected. Mechanical force applied to the anode 40 in the direction of the shoulder 18 holds the first spacing ring 24 and anode firmly in place against the shoulder. The aperture portion 44 and ring portion 42 of the anode 40 may be formed of a unitary structure, or may be comprised of separate elements that are combined together during assembly. It is anticipated that the anode 40 be comprised of an electrically conductive material, such as molybdenum.

A second spacing ring 62 is disposed concentrically within the shell 12 in abutting engagement with the ring portion 42 of the anode 40. The second spacing ring 62 has a generally cylindrical shape, with a forward end 64 that engages the step 52 of the ring portion 42, and a rearward end 65. The second spacing ring 62 has an inner surface 66 and an outer surface 68. The outer surface 68 of the second spacing ring 62 is of a diameter somewhat less than the inside diameter of the shell 12, so that a space is formed therebetween. The space allows for the passage of the electrical conductor 54 to the anode from an external voltage source. Mechanical force applied to the second spacing ring 62 in the direction of the shoulder 18 holds the second spacing ring, anode 40, and first spacing ring 24 firmly in place against the shoulder. It is anticipated that the second spacing ring 62 be comprised of an electrically insulative material, such as ceramic.

A cathode assembly 70 is disposed concentrically within the shell 12 in abutting engagement with the rearward end 65 of the second spacing ring 62. The cathode assembly 70 has a ring portion 72 and a capsule portion 74. As with the anode 40, an outer edge 76 of the ring portion 72 extends outwardly between steps 78 and 82. Step 78 engages the rearward end 65 of the second spacing ring 62. The capsule portion 74 includes a thermionic emitting cathode having an electron emitting surface 84 and focusing electrode 86. An electrical conductor 88 is connected to the cathode emitting surface 84 to provide a negative potential thereto. Similarly, an electrical conductor 92 is connected to the ring portion 72 for applying a potential to the focusing electrode 86, although the focusing electrode may also be at the same potential as the cathode surface 84, depending on the desired focusing characteristics of the electron gun. Mechanical force applied to the cathode ring portion 72 in the direction of the shoulder 18 holds the cathode, second spacing ring 62, anode 40, and first spacing ring 24 firmly in place against the shoulder.

A third spacing ring 94 is disposed concentrically within the shell 12 in abutting engagement with the ring portion 72 of the cathode 70. A forward end 96 of the third spacing ring 94 engages the step portion 82 of the cathode ring portion 72. Like the second spacing ring 62, the third spacing ring has an outside diameter somewhat less than the inside diameter of the shell 12 so that a space is formed therebetween. The space permits the passage of the electrical conductor 54. Mechanical force applied to the third spacing ring 94 in the direction of the shoulder 18 holds the third spacing ring, the cathode ring portion 72, the second spacing ring 62, the anode 40, and the first spacing ring 24 firmly in place against the shoulder. It is anticipated that the third spacing ring 94 be comprised of an electrically insulative material, such as ceramic.

The mechanical force applied to the third spacing ring 94, the cathode 70, the second spacing ring 62, the anode 40, and the first spacing ring 24 is provided by a snap ring 95. The snap ring 95 has an outside diameter which extends into the groove 22 disposed in the inner surface of the shell 12. The snap ring 95 has an inside diameter with a slight bow, providing a spring bias which applies a mechanical force on the rearward end 98 of the third spacing ring 94 to maintain the components of the electron gun in firm mechanical connection together. The snap ring 95 is removable so that each of the electron gun components can be readily withdrawn from the shell 12. It is anticipated that alternative structures be utilized to apply the mechanical force, such as threaded member including screws or nuts, or force-fit plugs.

Variation of the widths of the spacing rings 24, 62, 94 alters the relative placement of the anode 40 and cathode 70.

In so doing, the position of equipotential surfaces between the anode and cathode will change, thus altering the focusing characteristics of the electron gun 10. An electron gun having custom focusing characteristics can be provided by selection of relative widths for the spacing rings. Ceramic materials can be precision ground to provide the desired widths for the spacing rings. This way, standard anode and cathode elements can be utilized to achieve desired focusing characteristics by merely varying the dimensions of the spacing rings. Further incremental variations in spacing are achieved by use of shims 75, such as disposed between the second spacing ring 62 and the ring portion 42 of the anode and ring portion 72 of the cathode.

The spacing rings enable the anode 40 and cathode 70 to be effectively suspended within the shell 12. Both the anode outer edge 46 and the cathode outer edge 76 have diameters smaller than the inside diameter of the shell 12, so that a space is provided therebetween. Accordingly, the anode and cathode are electrically insulated from the shell 12 and from each other. It is anticipated that the shell 12, anode 40, and cathode ring 72 be constructed of materials having good structural strength and thermal expansion characteristics to allow consistent force over the operative temperature range without over-stressing or damaging the ceramic spacing rings.

Referring to FIG. 4, the cathode emitting surface 84 is electrically connected to a negative voltage source 80. The anode 40 is electrically connected to ground. The focusing electrode 86 may also be electrically connected to a voltage source 90, having a potential between the negative potential applied to the cathode and ground. The electron gun 10 is connected to a microwave device having an interaction region 30 and a collector 35.

By applying a negative voltage to the cathode emitting surface 84, electrons are drawn from the surface that pass through the beam hole 58 of the anode 40, providing an electron beam 20. The path which the electrons follow is determined by the shape of equipotential surfaces defined by the relative positions of the anode 40, the focusing electrode 86, and the cathode emitting surface 84. Within the interaction region, the electron beam 20 interacts with a propagating RF electromagnetic wave, in which energy of the beam is transferred to the wave. At the end of the interaction region 30, the beam 20 enters the collector 35 which recovers the remaining energy of the beam.

Figure 2:
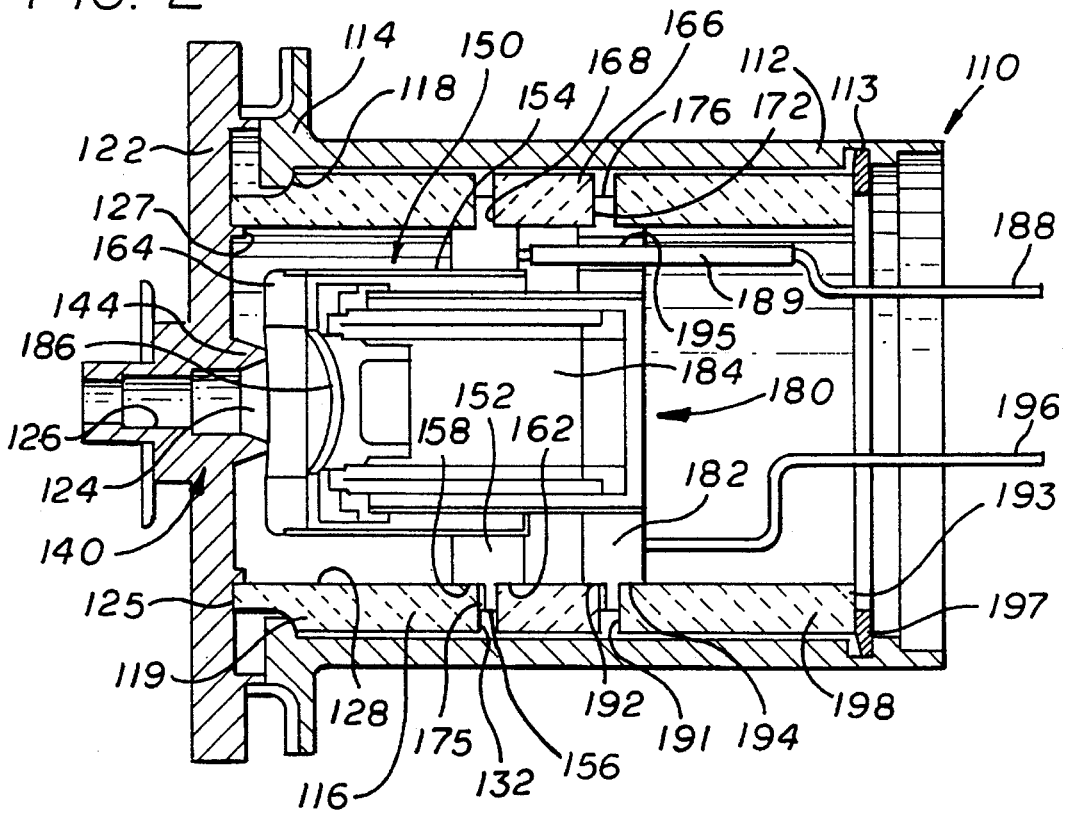
FIG. 2 is a sectional side view of an alternative embodiment of the electron gun.

An alternative embodiment of the electron gun is illustrated in FIG. 2. The electron gun 110 is shown connected to a portion of a microwave amplifying device that provides an anode for the electron gun. The microwave device 140 has an end member 122 with a central aperture 124 that leads to a beam tunnel 126. The beam tunnel 126 provides a passage for the electron beam emitted from the electron gun 110. An anode 144 surrounds the aperture 124 and provides a positive electrode which draws the electron beam from the cathode.

As in the previous embodiment, the electron gun 110 comprises an outer shell 112 having a generally cylindrical shape. A rim 114 having a shoulder 118 is disposed at a forward end of the shell 112, and is connected mechanically to the end member 122 of the microwave device 140. A first spacing ring 116 is disposed concentrically within the shell 112 in abutting engagement with the end member 122 of the microwave device. The first spacing ring 116 has a cylindrical inner surface 128. The end member may additionally have a lip 127 extending outwardly in the direction of the electron gun 110 that engages the inner surface 128 of the first spacing ring 116 to aid in alignment of the electron gun 110 to the microwave device 140.

The thickness of the first spacing ring 116 tapers at an outer surface thereof from a narrow portion at a forward end 125 of the spacing ring to a wide portion at a rearward end 132 of the spacing ring. A transition region 119 disposed between the narrow portion and wide portion provides a stop for engagement with the shoulder 118 of the rim 114. The first spacing ring 116 of this embodiment is similar to the first spacing ring 24 of the previous embodiment in shape, however, it has a substantially greater width. Mechanical force applied to the first spacing ring 116 in the direction of the shoulder 118 holds the spacing ring firmly in place.

A grid 150 is disposed concentrically within the shell 112 in abutting engagement with the rearward end 132 of the first spacing ring 116. The grid 150 has a ring portion 152 and a control portion 154. The ring portion 152 has an outer edge 156 extending outwardly between steps 158 and 162. Step 158 engages rearward end 132 of the first spacing ring 116. An electrical conductor 188 extends from the ring portion 152 of the grid 150, and permits electrical connection of the grid to an external voltage source. The control portion 154 of the grid 150 has a screen 164 which intersects with the electron beam of the electron gun 110. As known in the art, variation of the voltage applied to the screen 164 modulates the current of the electron beam. It is anticipated that the grid 150 be comprised of an electrically conductive material, such as molybdenum.

A second spacing ring 166 is disposed concentrically within the shell 112 in abutting engagement with the ring portion 152 of the grid 150. The second spacing ring 166 has a generally cylindrical shape, with a forward end 168 that engages the step portion 162, and a rearward end 172. It is anticipated that the second spacing ring 166 be comprised of an electrically insulative material, such as ceramic.

A cathode assembly 180 is disposed concentrically within the shell 112 in abutting engagement with the rearward end 172 of the second spacing ring 166. The cathode assembly 180 has a ring portion 182 and a capsule portion 184. As with the grid 150, an outer edge 176 of the ring portion 182 extends outwardly between steps 192 and 194. Step 192 engages the rearward end 172 of the second spacing ring 166. The capsule portion 184 includes a thermionic cathode having an electron emitting surface 186. An electrical conductor 196 is electrically connected to the cathode emitting surface 186 to provide a negative potential thereto. The ring portion 182 may further include a bore 195 to permit the passage of the electrical conductor 188 therethrough, and an insulator 189 may be used to electrically insulate conductor 188 from the cathode assembly.

A third spacing ring 198 is disposed concentrically within the shell 112 in abutting engagement with the ring portion 182 of the cathode 180. A forward end 191 of the third spacing ring 198 engages the step 194 of the cathode ring portion 182. It is anticipated that the third spacing ring 198 be comprised of an electrically insulating material, such as ceramic.

The third spacing ring 198, the cathode 180, the second spacing 166, the grid 150, and the first spacing ring 116 are pressed together by mechanical force provided by a snap ring 197. The snap ring 197 has an outside diameter which extends into a groove 113 disposed in the inner surface of the shell 112. The snap ring 197 has a spring bias which applies the mechanical force on a rearward end 193 of the third spacing ring 198 to maintain the components of the electron gun in firm mechanical connection together. The snap ring 197 is removable so that each of the electron gun components can be withdrawn from the shell 112.

It should be apparent that variation of the width of the spacing rings 116, 166, and 198 will alter the relative placement of the anode 140, grid 150, and cathode 180. As in the first embodiment discussed above, variation of the relative placement of the electrodes alters the position of equipotential surfaces, thus altering the focusing characteristics of the electron gun 110. Further incremental variations in spacing are achieved by use of shims 175 such as disposed between the first spacing ring 116 and the ring portion 152 of the grid.

Having thus described a preferred embodiment of a stacked ceramic electron gun assembly, it should now be apparent to those skilled in the art that certain advantages of the system have been achieved. It should also be appreciated by those skilled in the art that various modifications, adaptations, and alternative embodiments thereof may be made within the scope and spirit of the present invention. For example, a greater number of spacing rings and/or electrodes can be utilized within an electron gun to further vary the gun's focusing characteristics.

The present invention is further defined by the following claims.

What is claimed is:

1. An electron gun, comprising:

a shell comprising an inwardly protruding shoulder portion disposed at a first end thereof;

a cathode concentrically disposed within said shell and means for electrically connecting said cathode to an external negative voltage source;

a first electrically insulative spacing ring disposed within said shell in abutting engagement with said shoulder and said cathode, said cathode being electrically insulated from said shell by said first spacing ring;

an anode concentrically disposed within said shell in abutting engagement with said first spacing ring;

a second spacing ring disposed within said shell in abutting engagement with said anode, said cathode being in abutting engagement with said second spacing ring; and means for holding said cathode, said anode, said first spacing ring, and said second spacing ring rigidly together within said shell;

wherein said holding means is capable of detachment from said electron gun for removal of said cathode, said first spacing ring, and said second spacing ring from said shell.

2. The electron gun of claim 1, further comprising a third spacing ring disposed within said shell in abutting engagement with said cathode, said holding means being disposed adjacent to said third spacing ring.

3. The electron gun of claim 1, wherein said first and second spacing rings are comprised of ceramic material.

4. The electron gun of claim 1, further comprising a grid concentrically disposed within said shell.

5. The electron gun of claim 1, wherein said holding means is a snap ring.

6. The electron gun of claim 1, further comprising a shim disposed between said cathode and said first spacing ring.

7. An electron gun, comprising a cylindrical shell having a shoulder at a first end thereof;

a first electrically insulative spacing ring disposed within said shell in abutting engagement with said shoulder;

an anode in abutting engagement with said first spacing ring, and means for electrically connecting said anode to ground;

a second electrically insulative spacing ring disposed within said shell in abutting engagement with said anode, said anode being concentrically suspended within and electrically insulated from said shell by cooperation of said first and second spacing rings;

a cathode in abutting engagement with said second spacing ring, and means for electrically connecting said cathode to a negative voltage source;

a third electrically insulative spacing ring disposed within said shell in abutting engagement with said cathode, said cathode being concentrically suspended within and electrically insulated from said shell by cooperation of said second and third spacing rings; and means for holding said first spacing ring, anode, second spacing ring, cathode, and third spacing ring rigidly together within said shell, said holding means being detachable for removal of said first spacing ring, anode, second spacing ring, cathode, and third spacing ring from said shell.

8. The electron gun of claim 7, wherein said first, second and third spacing rings are comprised of ceramic material.

9. The electron gun of claim 7, wherein said first, second and third spacing rings each have a predetermined width, and a focusing characteristic of said electron gun is determined by selection of said predetermined widths.

10. The electron gun of claim 7, wherein said holding means is a snap ring.

11. An electron gun, comprising:

a cylindrical shell having a shoulder at a first end thereof;

a first spacing ring disposed within said shell in abutting engagement with said shoulder, said first spacing ring having a predetermined width;

an anode concentrically disposed within and electrically insulated from said shell in abutting engagement with said first spacing ring, and means for electrically connecting said anode to a first potential;

a second spacing ring disposed within said shell in abutting engagement with said anode, said second spacing ring having a predetermined width;

a cathode concentrically disposed within and electrically insulated from said shell in abutting engagement with said second spacing ring, and means for electrically connecting said cathode to a second potential, said second potential being negative with respect to said first potential;

a third spacing ring disposed within said shell in abutting engagement with said cathode, said third spacing ring having a predetermined width;

wherein, a focusing characteristic of said electron gun is determined by selection of said predetermined widths of said first, second, and third spacing rings.

12. The electron gun of claim 11, further comprising:

means for holding said first spacing ring, anode, second spacing ring, cathode, and third spacing ring together within said shell, said holding means being capable of detachment for removal of said first spacing ring, anode, second spacing ring, cathode, and third spacing ring from said shell.

13. The electron gun of claim 11, wherein said first, second and third spacing rings are comprised of ceramic material.

14. The electron gun of claim 11, wherein said electrode is an anode.

15. The electron gun of claim 11, wherein said electrode is a grid.

16. The electron gun of claim 11, further comprising at least one shim disposed between at least one adjacent pair selected from: said shoulder and said first spacing ring; said first spacing ring and said electrode; said electrode and said second spacing ring; said second spacing ring and said cathode; and said cathode and said third spacing ring.

* * * * *